United States Patent [19]

Janouschek

[11] Patent Number: 4,694,764

[45] Date of Patent: Sep. 22, 1987

[54] LATERALLY SWINGABLE SEWING MACHINE PRESSER DEVICE

[75] Inventor: Heinz Janouschek, Steckborn, Switzerland

[73] Assignee: F. Gegauf AG Bernina Nähmaschinenfabrik, Steckborn, Switzerland

[21] Appl. No.: 820,681

[22] Filed: Jan. 21, 1986

[30] Foreign Application Priority Data

Jan. 31, 1985 [CH] Switzerland ..... 420/85

[51] Int. Cl.[4] ..... D05B 29/00

[52] U.S. Cl. ..... 112/237

[58] Field of Search ..... 112/235, 237, 23, 240, 112/274

[56] References Cited

U.S. PATENT DOCUMENTS

| | | | |
|---|---|---|---|
| 668,221 | 2/1901 | Rontke | 112/235 |
| 1,016,462 | 2/1912 | Weis | 112/235 |
| 1,930,628 | 10/1933 | Smallbone | 112/240 |
| 2,419,494 | 4/1947 | Knaus | 112/235 |
| 2,836,137 | 5/1958 | Ayres | 112/237 |
| 3,055,326 | 9/1962 | Greulich | 112/235 |

FOREIGN PATENT DOCUMENTS 1488364 10/1977 United Kingdom .

*Primary Examiner*—Werner H. Schroeder
*Assistant Examiner*—Andrew M. Falik
*Attorney, Agent, or Firm*—Werner W. Kleeman

[57] ABSTRACT

The presser-foot of the fabric presser device in a sewing machine is pivotable about an axis of a presser-bar in order to provide space in the stitching region of a needle in order to allow manipulations to be made to the needle. The fabric presser device is constructed such that the presser-foot can be pivoted or swung away from the region of the needle only when the needle and the presser-bar are in a raised or elevated position.

14 Claims, 8 Drawing Figures

LATERALLY SWINGABLE SEWING MACHINE PRESSER DEVICE

BACKGROUND OF THE INVENTION

The present invention broadly relates to a new and improved construction of a fabric presser device for sewing machines and to a new and improved construction of a sewing machine incorporating such fabric presser device.

In its more particular aspects, the present invention specifically relates to a new and improved construction of a fabric presser device for sewing machines and which fabric presser device has a spring loaded presser-foot which is laterally pivotable below a needle bar or carrier and out of a stitching region of the needle.

In order that there may be facilitated the threading-in or inserting operation of the needle, especially when working with bulky special presser-feet or with attachments such as edge cutters, it would be desirable to swing or pivot the presser-foot away from the stitching region of the needle during these manipulations.

A presser-foot as known, for example, from U.S. Pat. No. 2,419,494, granted Apr. 22, 1947, and British patent No. 1,488,364, published Oct. 12, 1977, is mounted at the free end of a horizontal arm which is arranged substantially parallel to the direction of sewing and which is pivotable about a horizontal axis and a vertical axis. The presser-foot is pressed into contact by means of a spring loaded plunger which acts upon the arm and is located to the rear of the presser-foot.

Presser-feet which are fastened at the lower end of an axially displaceable presser-bar arranged substantially parallel to the needle bar or carrier, cannot be pivoted away from the stitching region of the needle in the manner described in the aforementioned patents.

SUMMARY OF THE INVENTION

Therefore, with the foregoing in mind, it is a primary object of the present invention to provide a new and improved construction of a fabric presser device for sewing machines and which fabric presser device does not exhibit the aforementioned drawbacks and shortcomings of the prior art constructions.

Another and more specific object of the present invention aims at providing a new and improved construction of a fabric presser device for sewing machines and an improved sewing machine containing such fabric presser device and which fabric presser device contains a presser-foot which can be pivoted away from the stitching region of the needle and which is carried by a presser-bar arranged substantially parallel to the needle bar or carrier.

Yet a further significant object of the present invention aims at providing a new and improved construction of a fabric presser device for sewing machines and which fabric presser device is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the fabric presser device of the present development is manifested by the features that, the presser-foot is mounted at the lower end of a spring-loaded presser-bar which is mounted substantially parallel to the needle bar or carrier. The presser-foot is pivotable about a longitudinal axis of the presser-bar when the presser-bar is in an elevated or raised position.

In sewing machines having a presser-bar which is arranged substantially parallel to the needle bar or carrier, it is thus rendered possible to pivot or swing the presser-foot away from the stitching region of the needle in order to provide space for manipulations in the region of the needle.

Pivoting or swinging-out the presser-foot is only possible when the presser-bar is elevated so that neither the needle nor the presser-foot can be damaged during the pivoting or swing-out movement of the presser-foot.

When the presser-foot is pivoted or swung-out a protrusion or lug located at a presser-bar guide prevents the sewing machine from being set into operation.

A protrusion forming a blade-like structure at the presser-bar guide ensures that the presser-bar guide is located either completely within the guide groove or completely outside the guide-groove so that the sewing machine or the needle cannot be damaged when the sewing machine is set into operation.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
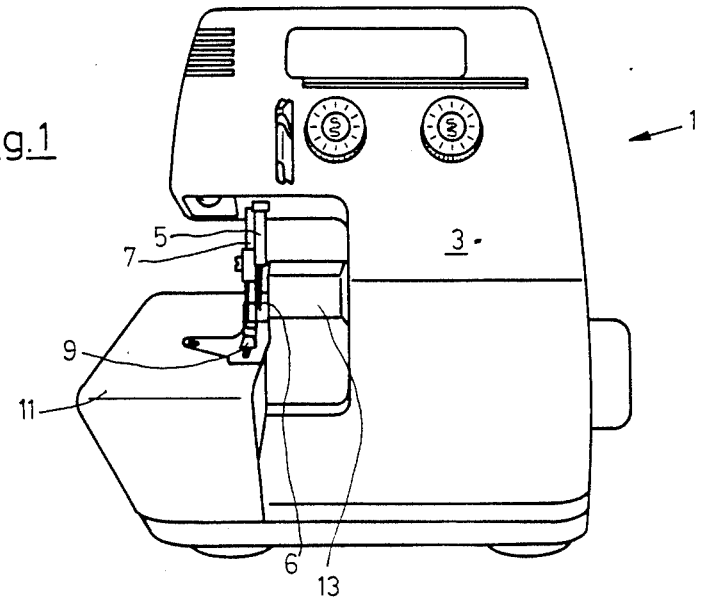
FIG. 1 shows a front view of an exemplary embodiment of the inventive sewing machine equipped with an exemplary embodiment of the inventive fabric presser device.

Describing now the drawings, it is to be understood that to simplify the showing thereof, only enough of the structure of the fabric presser device for sewing machines has been illustrated therein as is needed to enable one skilled in the art to readily understand the underlying principles and concepts of this invention. Turning now specifically to FIG. 1 of the drawings, the apparatus illustrated therein by way of example and not limitation, will be seen to comprise an overlock sewing machine 1 with a housing 3. In the top portion of the housing 3 there is mounted a needle bar or carrier 5 which contains a needle 6 and which is driven in conventional manner by not particularly illustrated suitable drive means. A presser-bar 7 is mounted for longitudinal displacement in the direction of its longitudinal axis A in the housing 3 and is arranged substantially parallel to the needle bar or carrier 5. A presser-foot 9 is mounted at a predetermined or lower end 7*a* of the presser-bar 7. The presser-foot 9 is located substantially parallel to a sewing machine table or support 11.

An edge cutter 13 is schematically illustrated on the right of the needle bar or carrier 5 and such edge cutter 13 is primarily employed in connection with overlock sewing machines. The needle bar or carrier 5 and the presser-bar 7 are guided in conventional manner in the housing 3.

Figure 2:
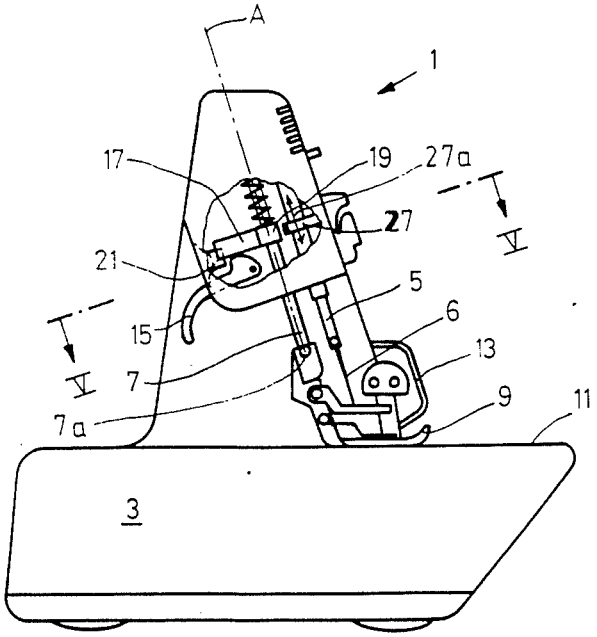
FIG. 2 shows a partially cut-away side view of the sewing machine illustrated in FIG. 1.
Figure 3:
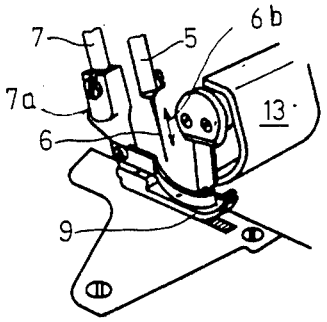
FIG. 3 is a perspective illustration of the stitching region in the sewing machine shown in FIG. 1.
Figure 4:
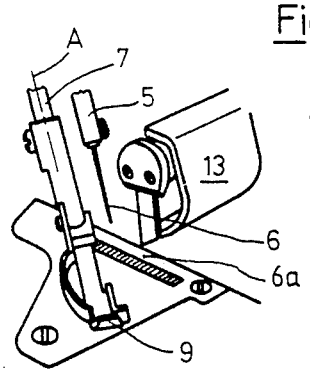
FIG. 4 is a perspective illustration of the stitching region in the sewing machine shown in FIG. 1 and with the presser-foot of the fabric presser device shown in FIG. 1 pivoted or swung-out away from the stitching region of the needle.

Means for raising or lifting the presser-bar 7 for displacement along its longitudinal axis A in order to thereby raise or lift the presser-foot 9 constitute a raising or lifting lever 15 which engages a presser-bar guide 17 which, as shown in FIG. 2, extends substantially perpendicular to the longitudinal axis A and which is mounted at the presser-bar 7 by means of a connecting element 19. One end of the presser-bar guide 17 extends substantially parallel to the longitudinal axis A of the presser-bar 7 and engages guide means 21 containing a guide groove 21*a*, which is arranged substantially parallel to the longitudinal axis A of the presser-bar 7 at the housing 3, such that the presser-bar 7 and the presser-foot 9 which is mounted at the presser-bar 7, cannot rotate, see FIGS. 1, 2, 5 and 6. The guide groove 21*a* is open on one side 23*b* at the upper end 21*b*, i.e. one of two lateral surfaces and which define the guide groove 21*a*, does not extend upwardly as far as the opposite surface. When the presser-bar 7 is in its fully raised or lifted position, the presser-bar guide 17 conjointly with the presser-bar 7 and the presser-foot 9 can be pivoted or swung about the longitudinal axis A of the presser-bar 7. Consequently, the presser-foot 9 is laterally pivoted or swung-out away from a stitching region 6*a* defined by the needle 6. During such lateral pivoting movement of the presser foot 9, the presser-bar guide 17 is laterally pivoted out of the guide groove 21*a* of the guide means 21.

Figure 5:
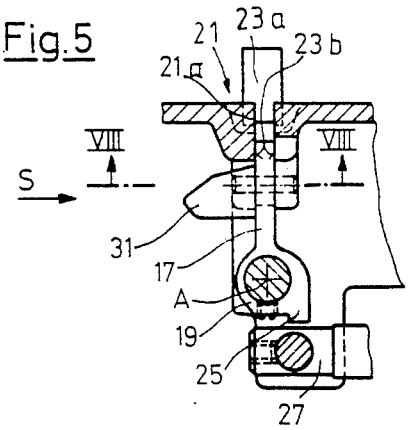
FIG. 5 is a cross-section through the lateral presser-bar guide along the line V—V in FIG. 2.
Figure 6:
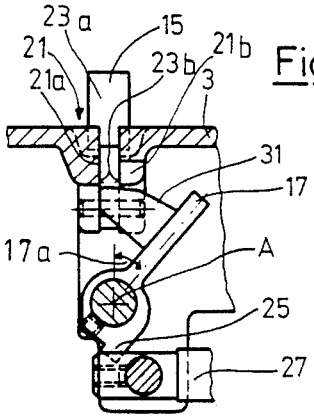
FIG. 6 is a cross-section through the lateral presser-bar guide illustrated in FIG. 2 and with the presser-foot pivoted or swung-out away from the stitching region of the needle.

The connecting element 19 which is mounted at the presser-bar guide 17, possesses a protrusion or lug 25 which extends very close to an entrainment member 27 for displacing the needle bar or carrier 5 and thereby the needle 6 along a predetermined displacement path 6*b*, see FIGS. 5 and 6. A protrusion 30 at a lower or bottom edge 29 of the presser-bar guide 17 is constructed as a blade-like structure or wing 31 which protrudes over the lower or bottom edge 29 of the presser-bar guide 17 and extends substantially parallel to the sewing machine table or support 11. The blade-like structure or wing 31 also extends substantially perpendicular to the presser-bar 7 and its longitudinal axis A. The blade-like structure or wing 31 may also form a bent-off portion of the presser-bar guide 17.

Figure 7:
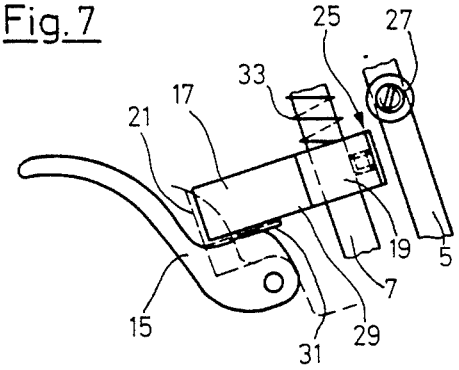
FIG. 7 shows a partial view of the presser-bar and the lifting device or lever in the sewing machine illustrated in FIG. 1 and as seen in the direction of the arrow S in FIG. 5.
Figure 8:
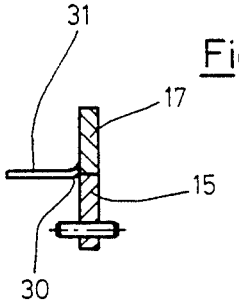
FIG. 8 shows a section along the line VIII—VIII in FIG. 5 through the presser-bar guide in the sewing machine illustrated in FIG. 1.

The blade-like structure or wing 31 rests upon the raising or lifting lever 15 when the presser-bar 7 is raised or lifted and the presser-foot 9 is laterally pivoted or swung-out, and prevents the presser-bar 7 from sliding or slipping downwardly. The lower or bottom edge 29 of the presser-bar guide 17 is set back from the bottom surface of the blade-like structure or wing 31 and thereby forms the protrusion 30, see FIGS. 7 and 8. The presser-bar guide 17 thus protrudes over the lower or bottom edge 29 such that the presser-bar guide 17 latches or locks with the raising or lifting lever 15 when the presser-foot 9 is pivoted or swung back. The presser-bar guide 17 thus necessarily comes to lie substantially exactly above the guide groove 21*a* and thus can be pivoted or swung-away from the region of the guide groove 21*a* only by overcoming a predetermined resistance.

A spring 33 urges the presser-bar 7 downwardly and holds the presser-bar 7 in engagement with the raising or lifting lever 15 in the raised or elevated position of the presser-bar 7.

The protrusion or lug 25 is directed to the needle bar or carrier 5 and cooperates with the entrainment member 27 for the needle bar or carrier 5 in such a manner that the presser-foot 9 can be pivoted or swung-out only if the needle 6 is located in the uppermost or top region of its displacement path 6*b*, i.e. outside of the displacement path of the presser-foot 9. Conversely, it is impossible in the pivoted or swung-out position of the presser-foot 9 to downwardly move the needle 6 because in such swung-out position of the presser-foot 9 the protrusion or lug 25 at the connecting element 19 projects into a predetermined displacement path 27*a* of the entrainment member 27 for displacing the needle bar or carrier 5, see FIGS. 2 and 6.

Furthermore, the entrainment member 27, the needle bar or carrier 5, and the needle 6 are displaceable between an upper and a lower position. The presser-bar guide 17, the presser-bar 7 and the presser-foot 9 are displaceable into the raised or lifted position by means of the raising or lifting lever 15. In this raised or lifted position the presser-bar guide 17, the presser-bar 7, the presser-foot 9, and also the connecting element 19 and its projection or lug 25 are pivotable through a predetermined pivot range or angle 17*a*. The arrangement is such that the entrainment member 27, in the aforementioned lower position of the entrainment member 27, the needle bar or carrier 5 and the needle 6, projects into the predetermined pivot range or angle 17*a* through which the connecting element 19 including its projection or lug 25 is pivotable. The lateral pivoting or swing-out movement of the presser-bar 7 and its associated components, which was described hereinbefore with reference to the upper position of the needle 6 and its associated components, is effectively prevented or blocked by the entrainment member 27 in the lower position of the needle 6 and its associated components. In such manner damage to the presser-foot 9 and of the needle 6 can be avoided.

The invention is not limited to the presently described type of sewing machines, i.e. overlock sewing machines, but actually can be employed in combination with all other types of known sewing machines which contain a presser-bar.

In lieu of the presser-foot 9 described hereinbefore and which is fixedly mounted at the end of the presser-bar 7 and which is rotatable conjointly therewith, a presser-foot 9 which is pivotably attached to the predetermined or lower end of the presser-bar 7 is also included in the scope of the present invention. In such case locking means of conventional construction are provided for holding the presser-foot 9 in the direction of the seam during the sewing operation.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A fabric presser device for sewing machines possessing a needle bar carrying a needle, comprising:
- a spring-loaded presser-bar possessing a predetermined end;
- said presser-bar possessing a longitudinal axis;
- said presser-bar being arranged substantially parallel to said needle bar;
- a presser-bar guide;
- a connecting element;
- said presser-bar guide being attached to said presser-bar by means of said connecting element;
- guide means extending substantially parallel to said longitudinal axis of said presser-bar and guiding said presser-bar guide;
- said guide means containing a guide groove defining one side and an open upper end on said one side of said guide groove;
- lifting means engaging said presser-bar guide for lifting said presser-bar;
- a presser-foot mounted at said predetermined end of said presser-bar;
- said presser-bar, when lifted into a raised position under the action of said lifting means upon said presser-bar guide, rendering pivotable said presser-foot about said longitudinal axis of said presser-bar such that said presser-foot is rendered laterally pivotable below said needle bar and away from a stitching region defined by said needle;
- a housing of said sewing machine;
- said presser-bar being mounted in said housing; and
- said presser-foot being pivotable conjointly with said presser-bar.

2. The fabric presser device as defined in claim 1, further including:
- said presser-bar guide extending substantially perpendicular to said longitudinal axis of said presser-bar;
- said presser-bar guide engaging said guide groove of said guide means; and
- said presser-bar guide being rendered laterally pivotable out of said guide groove when said presser-foot and said presser-bar are lifted into said raised position under the action of said lifting means.

3. A fabric presser device for sewing machines possessing a needle bar carrying a needle, comprising:
- a spring-loaded presser-bar possessing a predetermined end;
- said presser-bar possessing a longitudinal axis;
- said presser-bar being arranged substantially parallel to said needle bar;
- lifting means for lifting said presser-bar;
- a presser-foot mounted at said predetermined end of said presser-bar;
- said presser-bar, when lifted into a raised position under the action of said lifting means, rendering pivotable said presser-foot about said longitudinal axis of said presser-bar such that said presser-foot is rendered laterally pivotable below said needle bar and away from a stitching region defined by said needle;
- a housing of said sewing machine;
- said presser-bar being mounted in said housing;
- said presser-foot being pivotable conjointly with said presser-bar;
- a presser-bar guide;
- a connecting element;
- said presser-bar guide being attached to said presser-bar by means of said connecting element;
- said presser-bar guide extending substantially perpendicular to said longitudinal axis of said presser-bar;
- guide means containing a guide groove which extends substantially parallel to said longitudinal axis of said presser-bar;
- said presser-bar guide engaging said guide groove of said guide means;
- said presser-bar guide being rendered laterally pivotable out of said guide groove when said presser-foot and said presser-bar are lifted into said raised position under the action of said lifting means;
- said guide groove defining one side and an open upper end on said one side of said guide groove;
- said presser-bar guide defining a bottom edge facing said lifing means for lifting said presser-bar guide;
- a protrusion formed at said bottom edge of said presser-bar guide and protruding beyond said bottom edge of said presser-bar guide of said presser-foot; and
- said presser-bar guide being latched with said lifting means and aligned to said guide groove by means of said protrusion when said presser-foot and said presser-bar are lifted into said raised position under the action of said lifting means.

4. The fabric presser device as defined in claim 3, wherein:
- said protrusion is constructed as a substantially blade-like structure; and
- said substantially blade-like structure extending substantially perpendicular to said presser-bar and to said longitudinal axis of said presser-bar.

5. The fabric presser device as defined in claim 4, wherein:
- said lifting means for lifting said presser-bar constitute a lifting lever; and
- said substantially blade-like structure bearing upon said lifting lever when said presser-foot is laterally pivoted and said presser bar is lifted by said lifting lever into said raised position.

6. The fabric presser device as defined in claim 5, further including:
- an entrainment member for entraining said needle bar and movable along a predetermined displacement path;
- said connecting element containing a lug;
- said lug of said connecting element projecting into said predetermined displacement path of said needle bar entrainment member when said presser-foot is laterally pivoted and said presser-bar is lifted by said lifting lever into said raised position, in order to thereby prevent a downward displacement of said needle bar.

7. The fabric presser device as defined in claim 6, wherein:
- said needle assumes a lowered position during operation of said sewing machine;
- said connecting element being pivotable conjointly with said presser-bar through a predetermined pivot range; and
- said entrainment member which entrains said needle bar projects into said predetermined pivot range of said connecting element when said needle assumes said lowered position, in order to thereby prevent said lateral pivoting movement of said presser-foot.

8. A sewing machine comprising:
a needle bar carrying a needle;
a stitching region defined by said needle;
a spring-loaded presser-bar possessing a predetermined end;
said presser-bar possessing a longitudinal axis;
said presser-bar being arranged substantially parallel to said needle bar;
a presser-bar guide;
a connecting element;
said presser-bar guide being attached to said presser-bar by means of said connecting element;
guide means extending substantially parallel to said longitudinal axis of said presser-bar and guiding said presser-bar guide;
said guide means containing a guide groove defining one side and an open upper end on said one side of said guide groove;
lifting means engaging said presser-bar guide for lifting said presser-bar;
a presser-foot mounted at said predetermined end of said presser-bar;
said presser-bar, when lifted into a raised position under the action of said lifting means upon said presser-bar guide, rendering pivotable said presser-foot about said longitudinal axis of said presser-bar such that said presser-foot is rendered laterally pivotable below said needle bar and away from said stitching region defined by said needle;
a housing;
said presser-bar being mounted in said housing; and
said presser-foot being pivotable conjointly with said presser-bar.

9. The sewing machine as defined in claim 8, further including:
said presser-bar guide extending substantially perpendicular to said longitudinal axis of said presser-bar;
said presser-bar guide engaging said guide groove of said guide means; and
said presser-bar guide being rendered laterally pivotable out of said guide groove when said presser-foot and said presser-bar are lifted into said raised position under the action of said lifting means.

10. A sewing machine comprising:
a needle bar carrying a needle;
a stitching region defined by said needle;
a spring-loaded presser-bar possessing a predetermined end;
said presser-bar possessing a longitudinal axis;
said presser-bar being arranged substantially parallel to said needle bar;
lifting means for lifting said presser-bar;
a presser-foot mounted at said predetermined end of said presser-bar;
said presser-bar, when lifted into a raised position under the action of said lifting means, rendering pivotable said presser-foot about said longitudinal axis of said presser-bar such that said presser-foot is rendered laterally pivotable below said needle bar and away from said stitching region defined by said needle;
a housing;
said presser-bar being mounted in said housing;
said presser-foot being pivotable conjointly with said presser-bar;
a presser-bar guide;
a connecting element;
said presser-bar guide being attached to said presser-bar by means of said connecting element;
said presser-bar guide extending substantially perpendicular to said longitudinal axis of said presser-bar;
guide means containing a guide groove which extends substantially parallel to said longitudinal axis of said presser-bar;
said presser-bar guide engaging said guide groove of said guide means;
said presser-bar guide being rendered laterally pivotable out of said guide groove when said presser-foot and said presser-bar are lifted into said raised position under the action of said lifting means;
said guide groove defining one side and an open upper end on said one side of said guide groove;
said presser-bar guide defining a bottom edge facing said lifting means for lifting said presser-bar guide;
a protrusion formed at said bottom edge of said presser-bar guide and protruding beyond said bottom edge of said presser-bar guide of said presser-foot; and
said presser-bar guide being latched with said lifting means and aligned to said guide groove by means of said protrusion when said presser-foot and said presser-bar are lifted into said raised position under the action of said lifting means.

11. The sewing machine as defined in claim 10, wherein:
said protrusion is constructed as a substantially blade-like structure; and
said protrusion is constructed as a substantially blade-like structure; and
said substantially blade-like structure extending substantially perpendicular to said presser-bar and to said longituidnal axis of said presser-bar.

12. The sewing machine as defined in claim 11, where:
said lifting means for lifting said presser-bar constitute a lifting lever; and
said substantially blade-like structure bearing upon said lifting lever when said presser-foot is laterally pivoted and said presser-bar is lifted by said lifting lever into said raised position.

13. The sewing machine as defined in claim 12, wherein:
said connecting element contains a lug;
an entrainment member for entraining said needle bar;
displacing means for displacing said entrainment member and thereby said needle along a predetermined displacement path; and
said lug of said connecting element projecting into said predetermined displacement path of said needle bar entrainment member when said presser-foot is laterally pivoted and said presser-bar is lifted by said lifting lever into said raised position, in order to thereby prevent a downward displacement of said needle bar.

14. The sewing machine as defined in claim 13, wherein:
said needle assumes a lowered position during operation of said sewing machine;
said connecting element being pivotable conjointly with said presser-bar through a predetermined pivot range; and
said entrainment member which entrains said needle bar project into said predetermined pivot range of said connecting element when said needle assumes said lowered position, in order to thereby prevent said lateral pivoting movement of said presser-foot.

* * * * *

UNITED STATES PATENT AND TRADEMARK OFFICE

CERTIFICATE OF CORRECTION

PATENT NO. : 4,694,764

DATED : September 22, 1987

INVENTOR(S) : HEINZ JANOUSCHEK

It is certified that error appears in the above-identified patent and that said Letters Patent is hereby corrected as shown below:

Claim 11, please delete lines 5 and 6.

Signed and Sealed this

Twenty-sixth Day of April, 1988

*Attest:*

DONALD J. QUIGG

*Attesting Officer*

*Commissioner of Patents and Trademarks*